US009510675B2

(12) United States Patent
Baranski

(10) Patent No.: US 9,510,675 B2
(45) Date of Patent: Dec. 6, 2016

(54) RETRACTABLE STORAGE SYSTEM

(71) Applicant: Tarek Baranski, Phoenix, AZ (US)

(72) Inventor: Tarek Baranski, Phoenix, AZ (US)

( * ) Notice: Subject to any disclaimer, the term of this patent is extended or adjusted under 35 U.S.C. 154(b) by 0 days.

(21) Appl. No.: 14/926,270

(22) Filed: Oct. 29, 2015

(65) Prior Publication Data

US 2016/0235194 A1 Aug. 18, 2016

Related U.S. Application Data

(60) Provisional application No. 62/075,911, filed on Nov. 6, 2014.

(51) Int. Cl.
*A47B 46/00* (2006.01)
*A47B 51/00* (2006.01)

(52) U.S. Cl.
CPC ..... *A47B 46/005* (2013.01); *A47B 51/00* (2013.01); *A47B 2051/005* (2013.01)

(58) Field of Classification Search
CPC .... A47B 46/00; A47B 46/006; A47B 51/00; A47B 2051/005
See application file for complete search history.

(56) References Cited

U.S. PATENT DOCUMENTS

| | | | |
|---|---|---|---|
| 714,206 | A | 11/1902 | Lippincott |
| 2,547,597 | A | 4/1951 | MRoggero |
| 2,555,254 | A | 5/1951 | Stebbins |
| 2,579,876 | A | 12/1951 | Stebbins |
| 4,076,351 | A | 2/1978 | Wyant |

(Continued)

FOREIGN PATENT DOCUMENTS

| | | | |
|---|---|---|---|
| DE | 2344640 | A1 | 3/1975 |
| EP | 1224887 | A1 | 7/2002 |

OTHER PUBLICATIONS

Documentation regarding "Rev-A-Shelf 5pd-24crn Pull Down Shelving System" obtained from http://www.homewarehq.com/rev-a-shelf-pull-down-shelving-system-5pd-24crn.aspx on Oct. 26, 2015, believed to be available at least as early as Sep. 18, 2014.

*Primary Examiner* — Daniel Rohrhoff
(74) *Attorney, Agent, or Firm* — Brad Bertoglio

(57) ABSTRACT

A pull-out and drop-down storage system maximizing storage space and providing a user with convenient access to otherwise difficult to access storage space. The storage system may comprise a stationary support structure, a moveable section, and a guide rail linked to the top of the moveable section by a connector to direct the motion of the movable section between a retracted position and a more accessible position. The guide rail may be configured to lead the movable section through a confined space during deployment and retraction. The storage system may include vertical guide rails extending vertically from the bottom to the top of the rear part of the movable section and a sliding carriage assembly attached to the stationary support structure that in concert with the vertical guide rails provide stability and control during a substantially vertical motion of the movable section. The storage system may include a pair of wheels attached to the movable section and horizontal guide rails that extend horizontally at the base of the stationary support structure from the rear to the front of the stationary support structure to assist in the motion of the movable section. In some embodiments, travel of the movable section may be defined by a full-extension horizontal slide mounted to the movable section and traveling along vertical rail guides when the movable section is extended outside an enclosing frame.

19 Claims, 12 Drawing Sheets

(56) References Cited

U.S. PATENT DOCUMENTS

| | | | | |
|---|---|---|---|---|
| 5,228,763 | A * | 7/1993 | Gingold | A47B 46/005 312/247 |
| 5,242,219 | A * | 9/1993 | Tomaka | A47B 46/005 220/485 |
| 5,531,159 | A | 7/1996 | Stubblefield | |
| 5,857,756 | A * | 1/1999 | Fehre | A47B 46/005 312/246 |
| 6,367,898 | B1 * | 4/2002 | Jobe | A47B 51/00 312/246 |
| 6,755,492 | B1 * | 6/2004 | Hyde | A47B 51/00 312/247 |
| 7,770,986 | B1 | 8/2010 | Simaitis | |
| 8,157,108 | B1 | 4/2012 | Waldrop | |
| 8,414,093 | B2 * | 4/2013 | Moran | A47B 51/00 312/246 |
| 8,424,693 | B1 * | 4/2013 | Hoover | A47F 5/0062 211/126.15 |
| 8,424,983 | B1 * | 4/2013 | Strauss | A47B 51/00 312/247 |
| 8,622,488 | B1 * | 1/2014 | Kilby | A47B 46/005 211/103 |
| 8,641,156 | B2 * | 2/2014 | Chow | A47B 51/00 312/247 |
| 2010/0060120 | A1 * | 3/2010 | Van Meter | A47B 51/00 312/242 |
| 2013/0181583 | A1 * | 7/2013 | Kobe | A47F 3/06 312/122 |
| 2014/0139080 | A1 * | 5/2014 | Pan | A47B 46/00 312/201 |
| 2016/0031354 | A1 * | 2/2016 | Miles | B60P 1/4414 211/1.51 |
| 2016/0166058 | A1 * | 6/2016 | Bunch | A47B 46/005 312/249.7 |

* cited by examiner

RETRACTABLE STORAGE SYSTEM

FIELD OF THE INVENTION

The present disclosure relates in general to a retractable storage system, which in some embodiments can reposition a storage area from a relatively inaccessible, retracted location to a more accessible location.

BACKGROUND

Many possible storage locations are either not being used or are underutilized because they are situated in locations that are difficult for people to access, such as upper kitchen and garage cabinets, upper shelves in pantries and walk-in closets, and upper shelves of storage racks. Further, many residential and commercial structures with high ceilings could add a lot of storage space without sacrificing floor space if there was a convenient way to access areas above the locations that are readily reachable by typical people.

Existing designs for retractable storage systems primarily employ one of two approaches—a pantographic framework or linkage arms mounted to a shelf, or fixed vertical guides that extend downward.

The most prevalent design of a retractable storage system uses a pantographic framework or linkage arms pivotally mounted to a shelf or shelves which swing the shelves outward and downward for more convenient access. However, when used with tall moveable shelves or cabinets, this system will cause the retractable shelf or cabinet to extend a considerable distance out from the front edge of the fixed cabinet or shelf as the unit is being lowered. This is because the retractable shelf or cabinet moves about the linkage arms in an arc as it is lowered. As a result, this design is not suitable for tight areas, such as a hallway closet having a front header wall section above the access door, as modifications would lead to either less downward motion or a reduction in the usable storage area. Further, in pantographic motion or linkage arm type designs, the bottom shelf is necessarily truncated or raised with limited usage of space underneath it, so as to provide clearance during movement of the retractable portion from the front edge of the top shelf on which the system may be mounted. This leads to the loss of critical storage space and makes this system particularly unsuitable for deep storage units.

The other prevalent design of a retractable storage system employs fixed vertical guides that extend from the front edge of the device down to the lowest point that may be reached by the moveable section. While this approach eliminates many of the shortcomings of the pantographic and linkage arm designs, the use of long vertical guides extending down from the front of the device is impractical—potentially limiting the functionality of any spaces underneath the device, adversely impacting the aesthetics of the installation, and complicating the ability to easily retrofit the device to existing structures with minimal impact. In addition, in places like closets, where space is tight, this design may not fit.

Thus there remains a need for a retractable storage system capable of accommodating a variety of heights and depths, maneuver through tight geometry, and functioning without the use of vertical guide rails extending down from the front of the unit or linkage arms.

SUMMARY

The present disclosure describes, amongst other things, a pull-out and drop-down storage system providing a user with access to otherwise difficult to access storage areas that may also include challenges related to a space with a restricted access geometry, without requiring stationary extensions below the stationary support structure so that the aesthetics of the installed device are not negatively impacted.

In one embodiment, the storage system may comprise a stationary support structure, a moveable section, and a guiding element, such as a guide rail, spanning an upper-rear portion and a lower-front portion of the stationary support structure. The guiding element can be linked to an upper portion of the moveable section with a connector to assist the motion of the movable section between a retracted position and a more accessible position. Multiple guiding elements can be utilized, such as one guiding element on each of the left and right sides of a movable storage section. The stationary support structure provides a place to affix the guiding elements. The stationary support structure could be an existing structure like the shelf and back wall above a clothing rack in a closet or it can be a separate structure that is affixed to any support structure such as a wall, a substantially horizontal shelf, or a ceiling. A connector element attaches the movable section to the guiding element in a manner that allows the connector to slide on the guiding element, such that the guiding element defines a path of motion for the movable storage section. The connector may be affixed to the movable section in a way that allows the movable section to rotate as needed as it moves between its retracted and more accessible position, such as a slide-and-pivot joint.

In some embodiments, the path defined by the guiding element may be continuously forward and non-ascending. In some embodiments, the path defined by the guiding element may be substantially a straight line. In some embodiments, the path defined by the guiding element may have a substantially horizontal portion extending from the upper-rear portion of the stationary support structure towards a point furthest forward, and substantially vertical portion extending down towards a lowest, furthest-forward position; in such embodiments, the substantially horizontal section and the substantially vertical section may be connected by a convex, curved section of the guiding element. A handle may be attached to a front lower portion of the movable storage section to facilitate deployment and retraction of the movable storage section.

In some embodiments, the guiding element may solve at least two issues presented by certain prior art devices: the ability to retract and deploy the movable storage section in tight places and the ability to use a movable section with varied height to depth ratio. As to issue of tight spaces, while the movable section transitions from its retracted to its more accessible position, in some embodiments, the back of the moveable section may be maintained near the rear of the stationary support structure, instead of arcing out away from the station support structure like the linkage arms systems described above. Further, the shape of the guiding element can be designed to get around tight spaces commonly present in small closets.

A pair of wheels may be provided, such as to facilitate smooth horizontal movement of the movable storage section. The wheels may be connected to a lower-rear portion of the movable storage section. A pair of horizontal guide rails may be provided, upon which the wheels may travel. The horizontal guide rails may be affixed to the stationary support structure, and may extend from a rear part of the stationary support structure to a front part of the stationary support structure.

In accordance with another aspect, the storage system may include vertical guide rails, such as a pair of parallel vertical guide rails affixed to a rear portion of the movable section. The system may also include one or more retention assemblies mounted to the stationary support structure to contact the vertical guide rails as they move towards the front of the stationary support structure. Preferably, the retention assemblies are sliding assemblies movably mounted to the stationary support structure, and include a retention mechanism positioned to contact the vertical guide rail(s) as they move towards the front of the stationary support structure. The retention mechanism may act to constrain horizontal movement of the movable section during a phase of substantially vertical travel. The sliding assemblies may include a spring. The spring may have a first portion fixed relative to the stationary support structure, and a second portion fixed relative to the retention mechanism. The spring may act to bias the retention mechanism rearward. The retention mechanism may include a roller bearing, which may enable rolling movement of the vertical guide rail relative to the retention mechanism. In other embodiments, the retention mechanism may include a slot sized to allow the vertical guide rail(s) to pass therethrough. A sliding carriage can be provided on which the roller bearing or slot can be affixed, and to which the spring may be attached. The sliding carriage may travel within a range of motion parallel with a path of movement of the movable section. When the movable section is extended forward, the sliding carriage may slide to a position such that the roller bearings are slightly outside a volume defined by the stationary support structure, such that the retention mechanism acts to constrain horizontal movement of the movable section during a phase of substantially vertical travel.

In accordance with another aspect, a storage system may include a stationary support structure, a moveable section, and one or more vertical rail guides affixed to the stationary support structure. The vertical rail guides may be positioned outside the movable storage section and may span the top and bottom of the stationary support structure. A horizontal slide may have a first portion affixed to an outside upper portion of the movable storage section, and a second portion slidably mounted on the vertical guide rails. The movable storage section may move horizontally via extension of the horizontal slide, and once extended forward, may move vertically via movement of the horizontal slide along the vertical guide rails. The movable storage section may include guide wheels, which may run on horizontal guide rails, to facilitate horizontal motion of the movable section. Sliding assemblies may be provided to, e.g., help constrain horizontal movement of the movable storage section during a phase of substantially vertical travel.

In accordance with other aspects, safety features may be provided to inhibit deployment of a movable section that is loaded to a weight that exceeds a desired maximum level, to prevent freefall of the movable section in the event of breakage, and/or to provide a visual indicator to a user when the weight of a movable section exceeds a threshold weight. One such embodiment may include a spring-loaded retractable rail section within a horizontal guide rail, which collapses under the weight of a rear guide wheel of an overloaded movable section.

Various other objects, features, aspects, and advantages of the present invention and embodiments will become more apparent from the following detailed description of preferred embodiments, along with the accompanying drawings in which like numerals represent like components.

DETAILED DESCRIPTION

The present disclosure describes, amongst other things, pull-out and drop-down storage systems enabling a user to access storage locations that might otherwise be difficult to access, while potentially maximizing usable storage area and minimizing required clearance.

Figure 1:
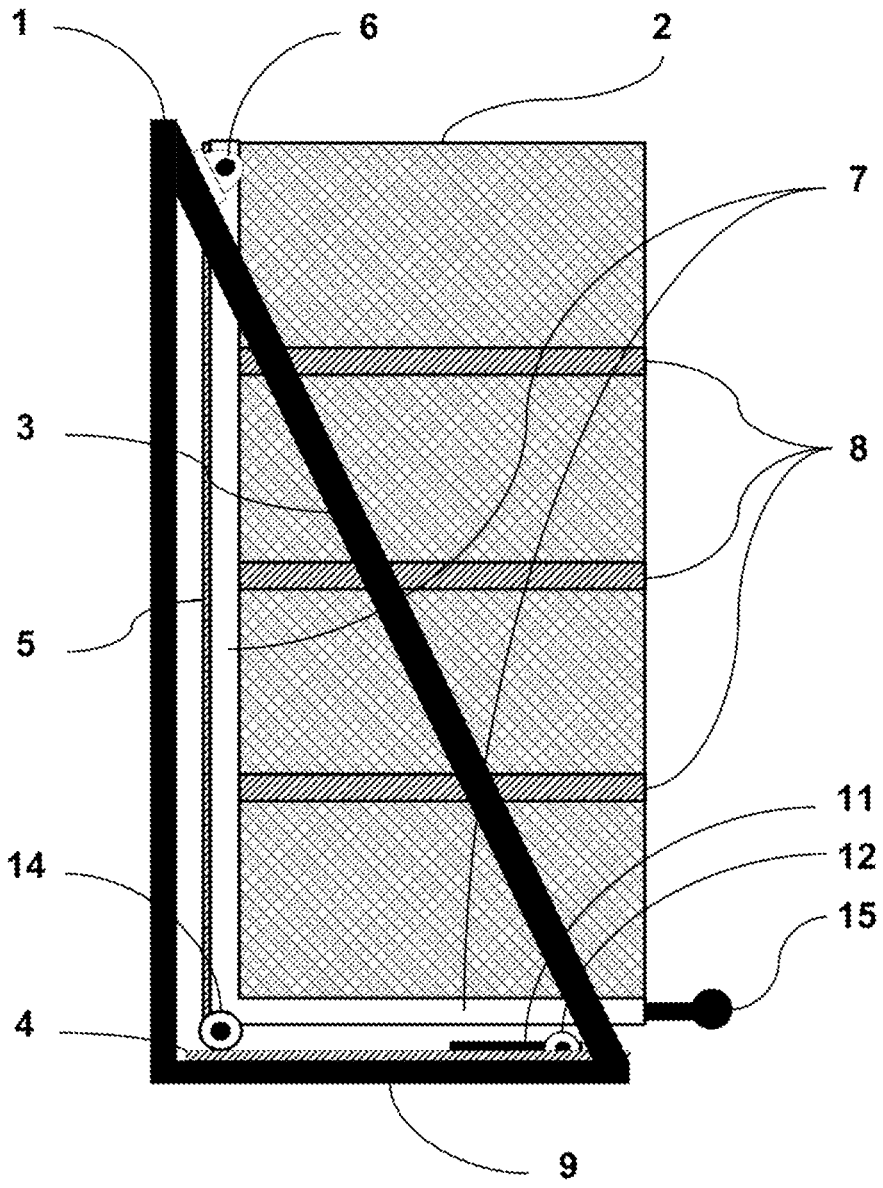
FIG. 1 is a side elevation of a movable storage system embodiment in a retracted position.

FIG. 1 is a side view of an embodiment of the retractable storage system having a movable storage section in a retracted position. Guiding element 3 spans a top-rear portion and a lower-front portion of a stationary support structure 1. In the embodiment of FIG. 1, stationary support structure 1 includes two L-shaped support frames 9 connected by cross members 10 (one of which is illustrated in FIG. 4). However, it is understood that in some embodiments, other stationary support structures may operate to support guiding element 3. In some embodiments, a pre-existing rack may be used to support guiding element 3. In some embodiments, guiding element 3 may be mounted directly to a pre-existing back wall and shelf as a support structure. These and other variations may be utilized in embodiments of the present disclosure.

Movable storage section 2, containing optional adjustable shelves 8, is linked to guiding element 3 by movable connector element 6. In the embodiment of FIG. 1, connector element 6 is a slide-and-pivot joint, moving freely along the length of guiding element 3, and affixed proximate a top-rear portion of corner of movable section 2 via a pivoting connector having an axis of rotation perpendicular to guiding element 3. Guiding element 3 provides stability and control of the movable section during all phases of its motion, dictating a path of travel for the top rear corner of the movable section to which connector element 6 is attached.

In some embodiments, movable section 2 includes left and right side frames 7 joined by back and bottom parts (not shown), to provide further rigidity to the movable section and secure mounting points for vertical guide rails 5, connector element 6, rear guide wheels 14 and handle 15.

Rear guide wheel 14 is mounted to the lower-rear corner of movable section 2 and can freely travel along horizontal guide rail 4. Horizontal guide rail 4 extends horizontally from the front to the rear of stationary support frame 9 and interact with guide wheel 14 to provide stability during horizontal motion of movable section 2. The bottom rear part of moveable section 2 remains engaged with the fixed horizontal guide rails while in the fully raised position and during the horizontal motion phases of its deployment.

The storage system may further comprise fixed vertical guide rails 5 which provide stability and control during vertical motion of the storage system. Fixed vertical guide rails 5 extend vertically from the bottom to the top of the rear part of the moveable section. Fixed vertical guide rails 5 provide stability during raising and lowering of the moveable section, as described further below.

Sliding carriage 11 and roller bearing 12 are shown in a rest position waiting for vertical guide rail 5 to engage roller bearing 12. Sliding carriage 11 may be attached to a front cross member connecting stationary support frames 9, and is illustrated further in FIGS. 4*a* and 4*b*.

A handle 15 is attached to movable section 2 to increase the ease of transitioning the movable storage between positions.

While illustrated in FIG. 1 in a left side view, a right side view (not shown) of the same embodiment would reveal components substantially duplicative of the left side view, including a matching guide rail, stationary support frame, slide-and-pivot connector element, rear guide wheel, vertical guide rail, horizontal guide rail, sliding carriage and roller bearing. Movable section 2 resides in between the left and right side components.

Figure 2:
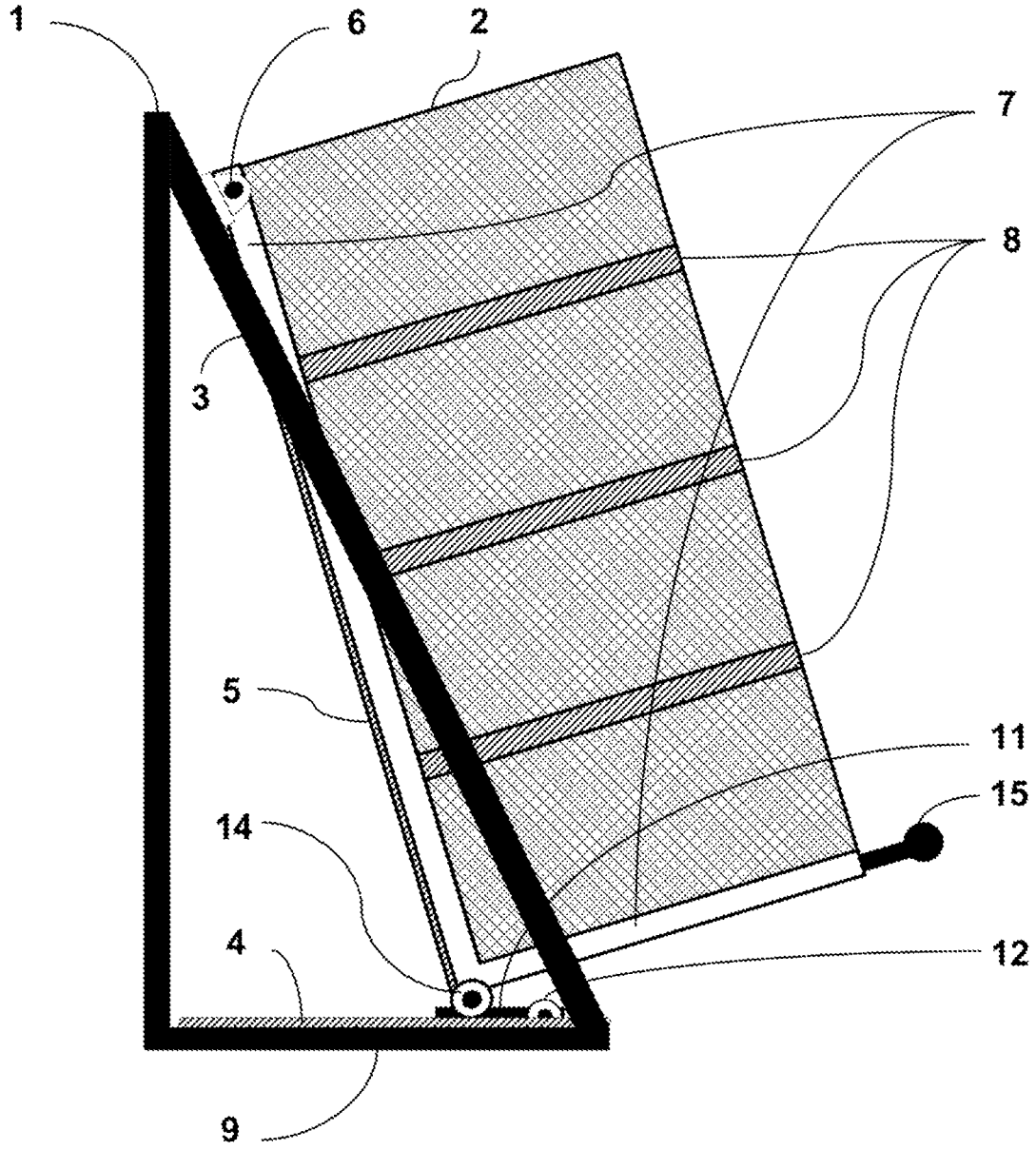
FIG. 2 is a side elevation of an embodiment while the moveable section is in a substantially horizontal motion phase.

FIG. 2 is a side view of an embodiment while the moveable section 2 is in its substantially horizontal motion phase, such as after a user has begun pulling handle 15 outwards from stationary support structure 1. As movable section 2 is pulled forward, it begins to tilt as its upper rear corners rotate around the axle of the connector elements 6. The degree of tilting will be controlled by the profile of side guide rail guiding elements 3. The pivot joints 6 will begin to slide along the fixed side guide rails 3 at a point in the horizontal motion that is determined by the angle of side guide rails 3.

Figure 3:
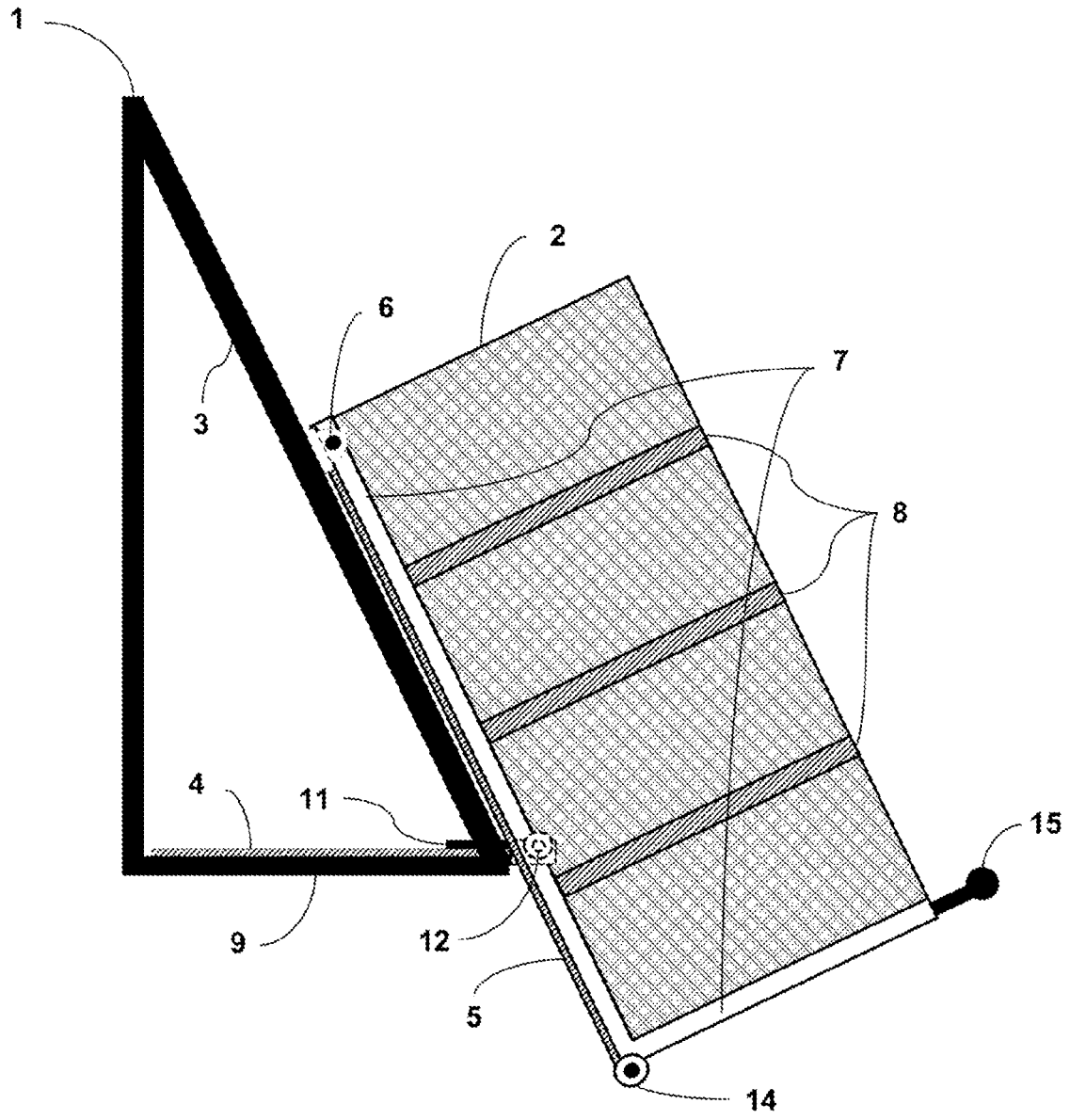
FIG. 3 is a side elevation of an embodiment while the moveable section is in a substantially vertical motion phase.

FIG. 3 is a side view of the embodiment of FIGS. 1 and 2, after movable section 2 has transitioned to a substantially vertical motion phase. During operation of the retractable storage system, when guide wheels 14 reach the front edge of stationary support structure 1, the bottom rear part of movable section 2 is released from horizontal guide rails 4. This initiates vertical motion of the moveable section. In some embodiments, fixed vertical guide rails 5 engage with a front portion of the stationary support structure via roller bearings 12, or in alternative embodiments via guide slots in a front portion of the support structure shaped to allow vertical guide rails 5 to pass therethrough, wherein the roller bearings or slots only fully engage the fixed vertical guide rails after the bottom rear part of the moveable section (and rear guide wheels 14) extends beyond the front edge of the stationary support structure. Roller bearings 12 (and/or guide slots) serve to control the motion of movable section 2 during the substantially vertical portion of its travel, inhibiting the back of movable section 2 from pulling away from the front edge of stationary support structure 1. While the retention mechanism illustrated in FIGS. 1-3 are sliding assemblies, it is contemplated and understood that stationary retention assemblies could also be utilized, although they may extend forward of the stationary assembly and thereby inhibit closure of doors or cabinetry in some applications.

Figure 4A:
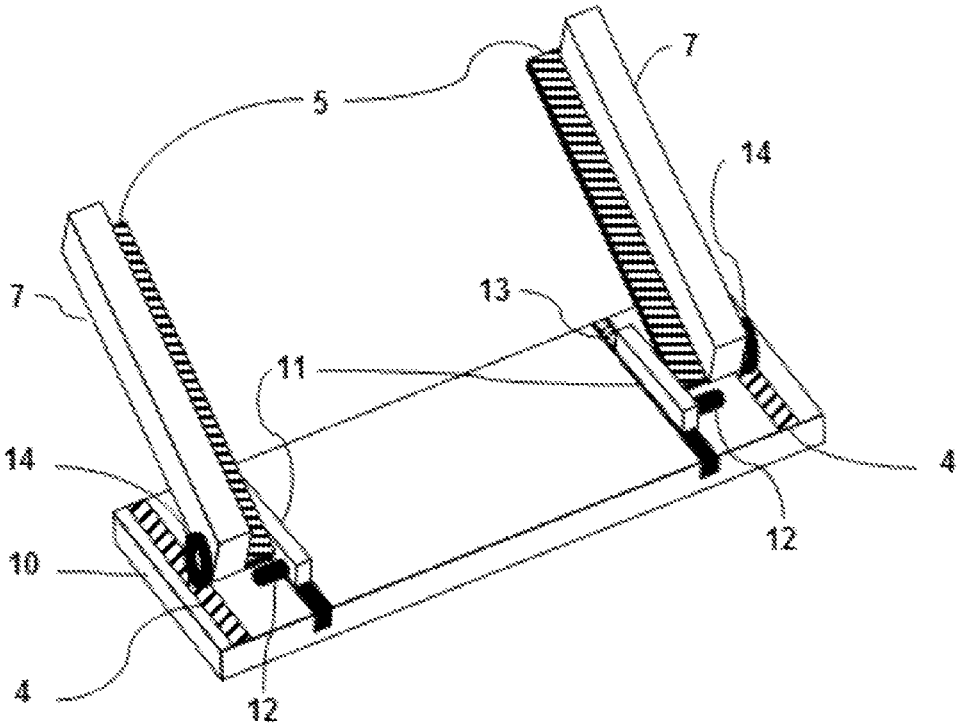
FIG. 4*a* is an oblique partial cutaway view of an embodiment in which vertical guide rails are engaging with roller bearings prior to a transition from a substantially horizontal motion phase to a substantially vertical motion phase.

FIG. 4*a* is a cutaway view of a portion of the retractable storage system in a position similar to that of FIG. 2, just prior to vertical guide rails 5 engaging with roller bearings 12 and sliding carriages 11. Cross member 10 adjoins L-shaped stationary support frames 9 (not shown). Sliding carriages 11 travel along slots in cross member 10, and are biased rearwards by spring 13. Roller bearings 12 extends laterally outwards from sliding carriages 11, just above the top surface of cross member 10. Meanwhile, the movable section travels along horizontal guide rails 4 via rear guide wheels 14 mounted to movable section side frames 7. Vertical guide rails 5 are mounted to side frames 7, extending inwards.

As the movable section (and in turn, side frames 7 and vertical guide rails 5) travels forward from the position of FIG. 4*a*, vertical guide rails 5 contact roller bearings 12 and push roller bearings 12 forward, along with sliding carriages 11. Springs 13 stretch, biasing sliding carriages 11 and roller bearings 12 against the forward motion, promoting continuous contact between vertical guide rails 5 and roller bearings 12. As guide wheels 14 reach the end of fixed horizontal guide rails 4, the maximum travel distance of sliding carriages 11 will also be attained. This will typically correspond to the edge of the stationary support structure. The horizontal motion phase of the moveable structure thus ends and the vertical motion phase begins.

While springs 13 are illustrated in FIG. 4*a* as metal coil extension springs, it is contemplated and understood that in some embodiments, other spring styles and constructions could be utilized to provide a rearward biasing force against sliding carriages 11; including, without limitation, elastomer springs, gas springs, bungee cords, torsion springs, and others. Furthermore, some embodiments utilize roller bearings 12 as a retention mechanism to constrain the horizontal movement of vertical guide rails 5 (and thus movable section 2) relative to stationary support structure 1 during a phase of substantially vertical travel, as the roller bearing may facilitate smooth movement of vertical guide rails 5, particularly while the retention mechanism is biased rearward against vertical guide rails 5 via spring action. However, it is contemplated and understood that other embodiments may include alternative retention mechanisms to constrain the horizontal movement of movable section 2 during a phase of substantially vertical travel. For example, as explained above, guide slots may be utilized. In other embodiments, low friction retainer arms (such as Teflon-coated retainers) may be utilized. These and other variations may be beneficially employed to constrain horizontal movement of movable storage section 2 during a phase of substantially vertical travel.

Figure 4B:
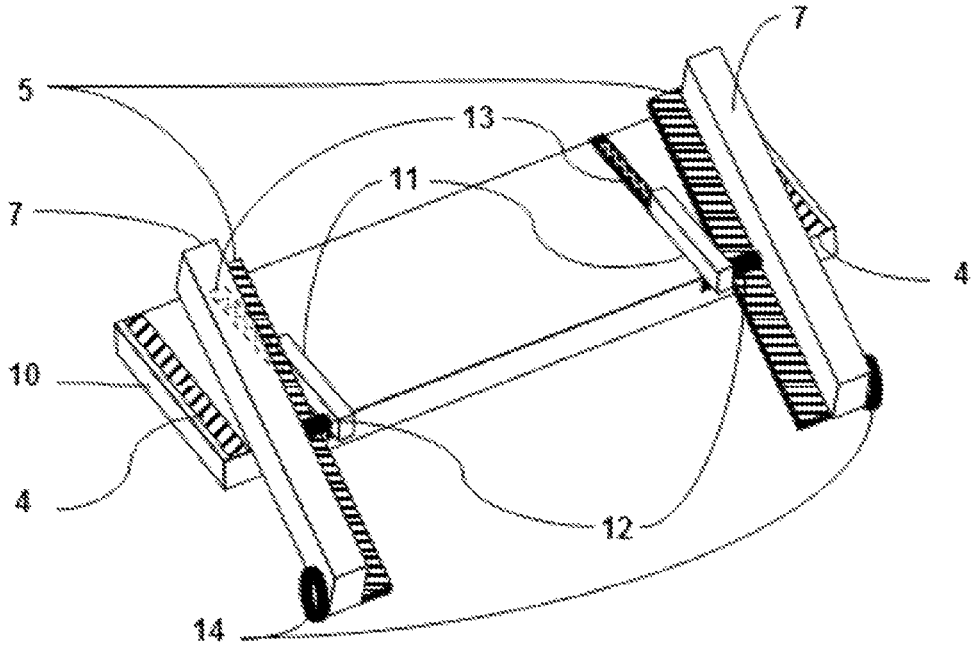
FIG. 4*b* is an oblique partial cutaway view of an embodiment in which vertical guide rails have engaged with roller bearings subsequent to a transition from a substantially horizontal motion phase to a substantially vertical motion phase.

FIG. 4*b* illustrates the retractable storage system of FIG. 4*a*, after the movable section is pulled off the front of the stationary support structure. As rear wheels 14 clear the front edge of horizontal guide rails 4, the movable storage section (including side frames 7 and vertical guide rails 5) begins traveling downward. Roller bearings 12 act against vertical guide rails 5 to constrain the motion of the movable section and inhibit the movable section from pulling away from the front edge of the stationary support structure, while also facilitating smooth movements downward. Roller bearings 12 and sliding carriages 11 also inhibit lateral motion of movable section 2. The slide and pivot joints that link the upper rear corners of the moveable section to the fixed side guide rails provide additional control and stability to the moveable section.

FIG. 3 illustrates the storage system as movable section 2 continues to move downward from the position of FIG. 4*b*. The maximum downward motion of the moveable section is attained when the slide and pivot joints reach either a moveable stop attached to guiding elements 3, or the end of guiding elements 3. The moveable section can then be raised to its retracted position in reverse order of the lowering process.

Embodiments of the retractable storage system may be operated manually or may be automated. In some embodiments, the storage system may include handle 15 to facilitate manual operation of the storage system. A user may pull handle 15 to lower moveable section 2 and push upward using handle 15 to raise moveable section 2.

In other embodiments, the storage system may further comprise an electronic control system whereby a user may electronically operate the storage system therewith. In such embodiments, electric motors may be utilized to act on the movable section. For example, a first electric motor may act on a lower rear portion of movable section 2 (proximate rear guide wheels 14) during the substantially horizontal movement phase, while a second electric motor may act on a top rear portion of movable section 2 (proximate connector elements 6) to control motion during the substantially vertical movement phase. In some embodiments, the guiding elements may comprise rails with toothed racks onto which a gear and motor assembly may engage, thereby enabling automated and/or electrically assisted lowering and raising of the movable storage section, or a braking system for a manually operated retractable storage system. In some embodiments, a constant force coil spring system may provide a counter balance that would reduce the force required by the user to lower and raise the moveable section. In some embodiments, a dampening system may be applied to the movable section to control the velocity of descent during use.

In some preferred embodiments, the storage system may be designed to be readily retrofitted into existing structures or be incorporated into the designs of new cabinets, cupboards, storage racks, or analogous storage units.

The storage system may be secured by mechanically fastening the stationary support structure to a desired location, such as the top of a shelf, inside a cabinet, or on a wall.

Embodiments of the retractable storage system may allow flexibility in the depth and height of the moveable section and thus are applicable to a wide variety of applications. The storage system may also be self-contained, requiring no parts to extend beyond the envelope of the device and thereby not interfering with spaces underneath the device except when the moveable section is lowered.

FIG. 5 illustrates an embodiment of the movable storage system particularly suited for, e.g., mounting within an upper shelf storage area of a closet having a door opening with a height lower than the interior ceiling height of the closet. In particularly, the embodiment of FIG. 5 enables deployment and retraction of a relatively large storage section, while still clearing front closet wall 30. In FIG. 5*a*, movable storage section 2 is illustrated in a retracted position. In FIG. 5*b*, movable storage section 2 has begun movement through its horizontal travel phase, with movable section 2 tipping back as rear guide wheels 14 roll forward.

Figure 5B:
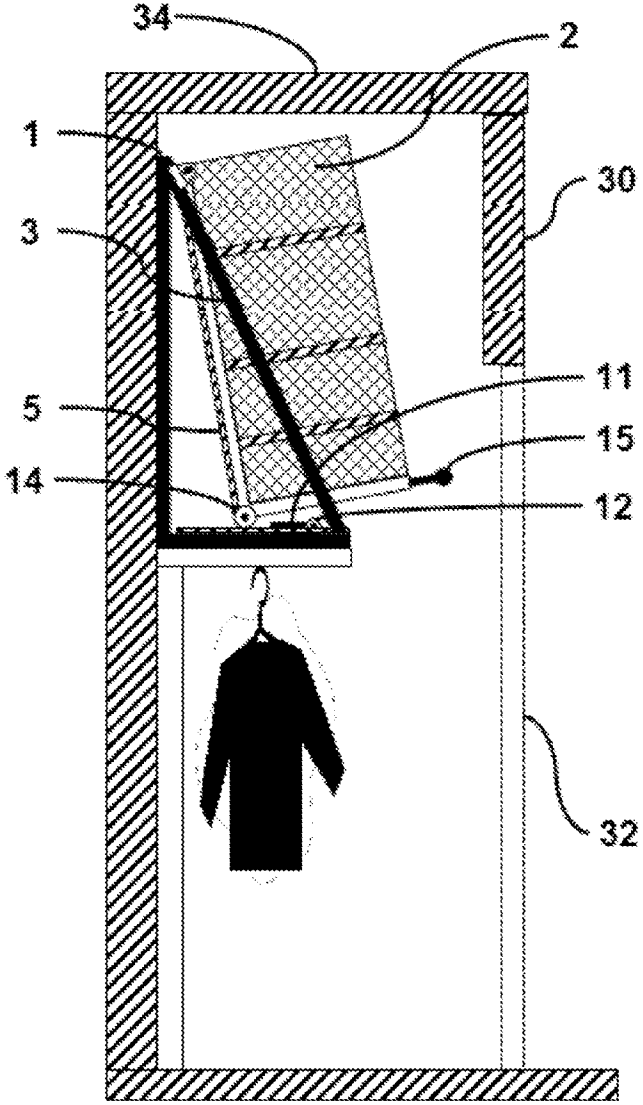
FIG. 5*a* through FIG. 5*d* are side views of an embodiment in different phases of deployment of the moveable section using a guiding element profile crafted for when forward clearance is limited.
Figure 5A:
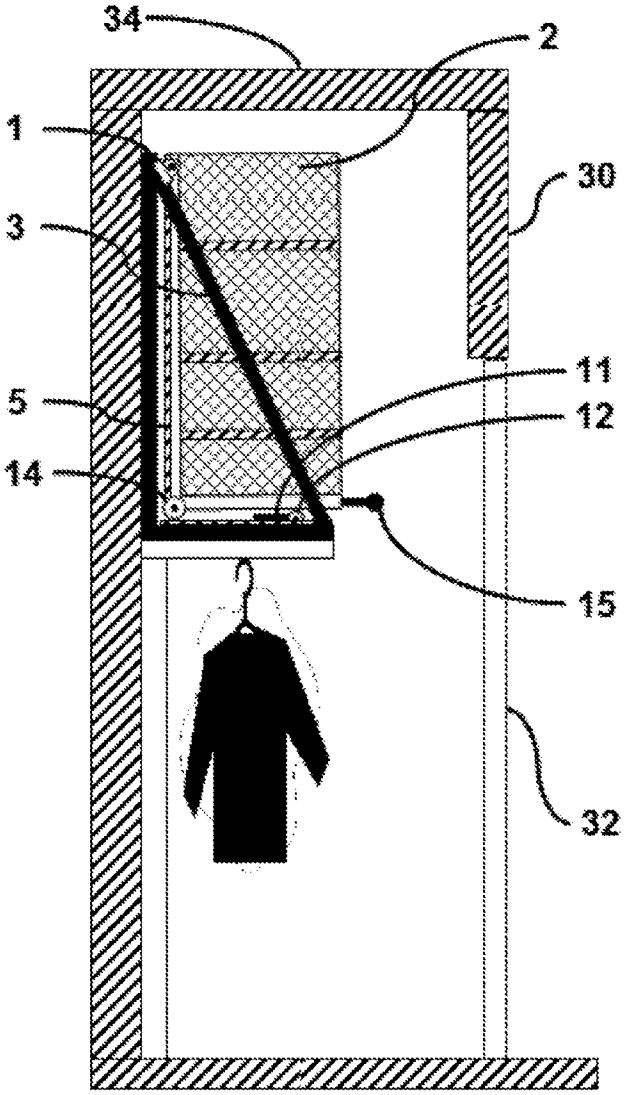
Figure 5D:
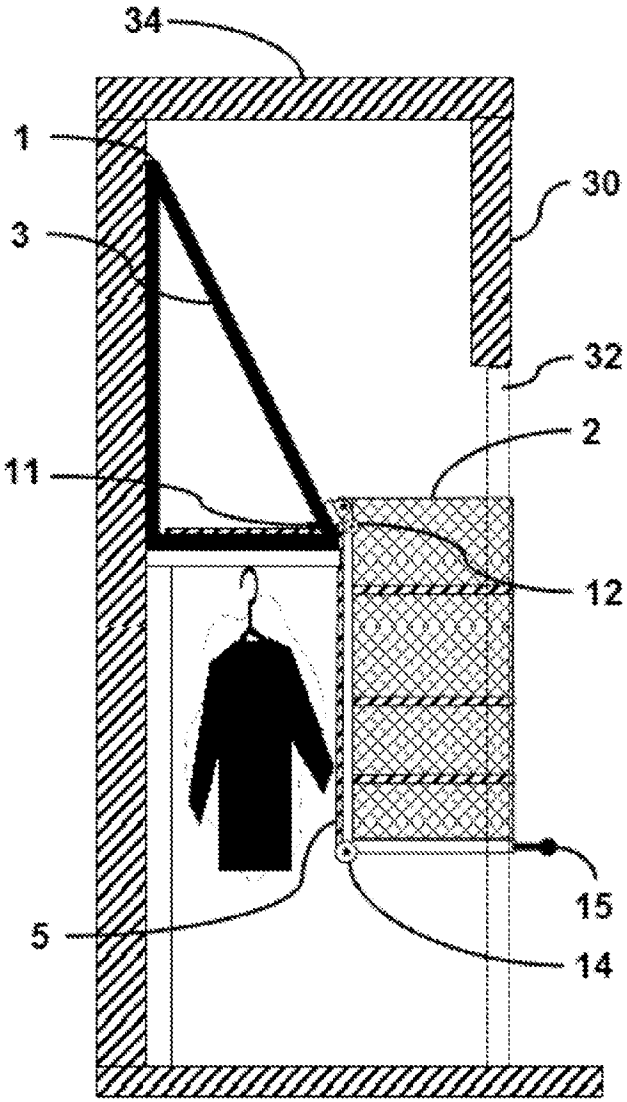
Figure 5C:
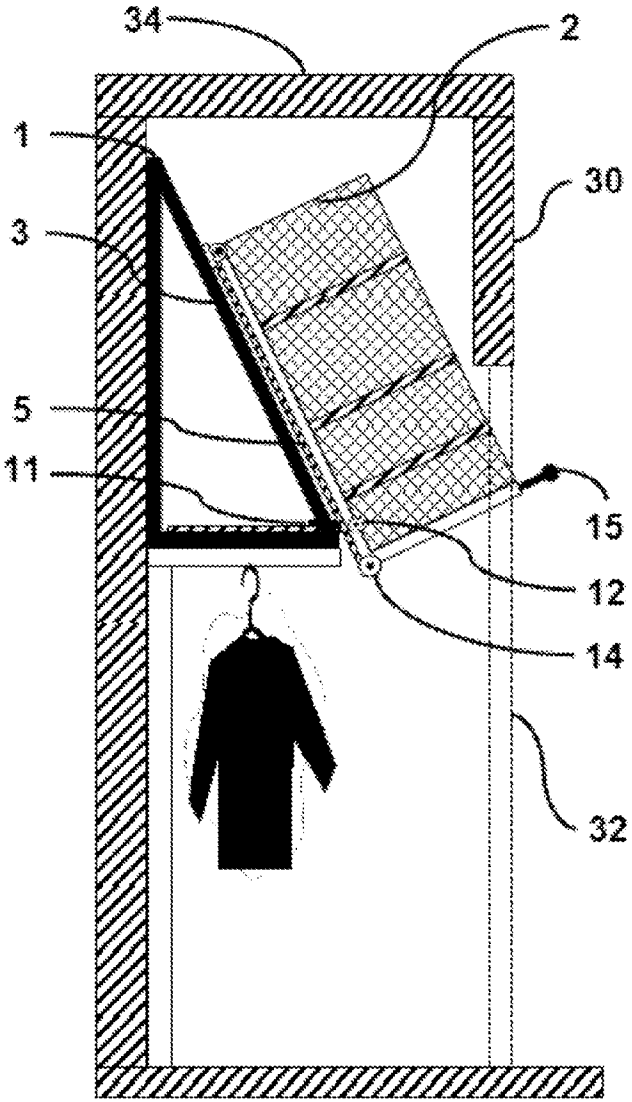

In FIG. 5*c*, movable storage section 2 has transitioned into a substantially vertical movement phase. The angle of guiding elements 3 (and therefore the angle of travel for movable section 2) facilitates clearance of front closet header wall 30 during travel of movable section 2. FIG. 5*d* shows movable section 2 in its extended position, lowered for easy access. The movable storage section can be retracted back up to its raised position by reversing the path of travel illustrates in FIGS. 5*a*-5*d*.

In some embodiments, particularly embodiments in which clearance of a front header wall is not a constraint, it may be desirable to reduce the extent to which movable section 2 tips, thereby minimizing disturbance of any contents stored therein. In other embodiments, it may be necessary to tip the movable section even more, such as to avoid a front header wall having even less clearance than that illustrated in FIG. 5. By altering the shape of the guiding elements 3, the angle at which the moveable section will tilt during the transition from its raised position to its lowered position may be adjusted, thereby allowing obstacles in front and above the device to be cleared as required.

FIG. 6 illustrates another embodiment, utilizing guiding elements having a substantially horizontal portion and a substantially vertical portion, with a curved section transitioning between them. The embodiment of FIG. 6 allows a movable storage section to be deployed and retracted with minimal tipping. In FIG. 6*a*, movable storage section 62 is mounted to stationary frame 61 via connector element 66 slidably attaching to guiding element 63, and positioned in a raised, retracted orientation.

Figure 6B:
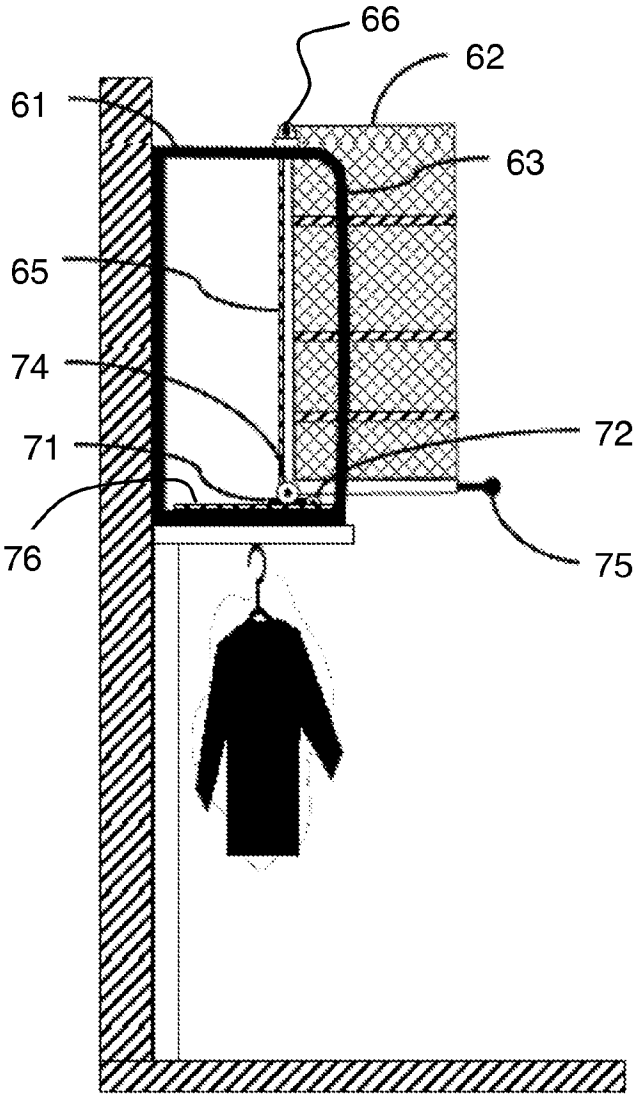
FIG. 6*a* through FIG. 6*d* are side views of an embodiment in different phases of deployment of the moveable section using a guiding element profile causing minimal inclination of the movable section during deployment.
Figure 6A:
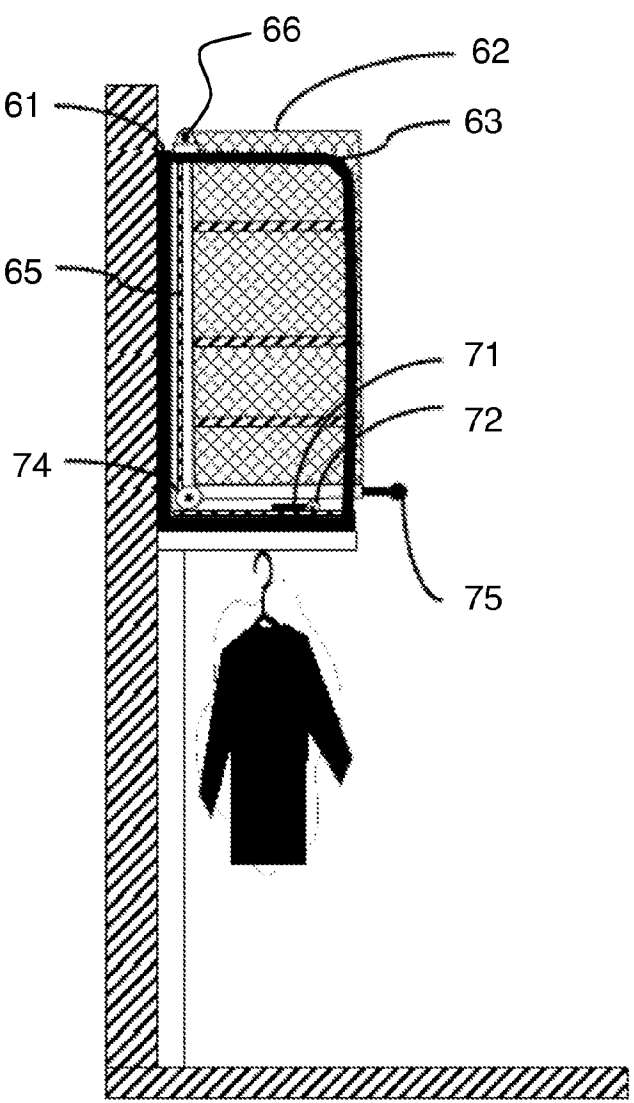

In FIG. 6*b*, movable section 62 is pulled forward via handle 75. Movable section 62 remains in a substantially neutral, untilted orientation as connector element 66 travels along a substantially horizontal portion of guiding element 63 and rear guide wheels 74 travel along horizontal guide rails 76. In FIG. 6*c*, movable section 62 transitions to a substantially vertical movement phase, as connector element 66 slides along a curved portion of guiding element 63 linking horizontal and vertical sections thereof. Movable section vertical guide rail 65 engages with sliding carriage 71 and roller bearing 72 to inhibit the back of movable section 62 from pulling away from stationary support structure 61.

Figure 6D:
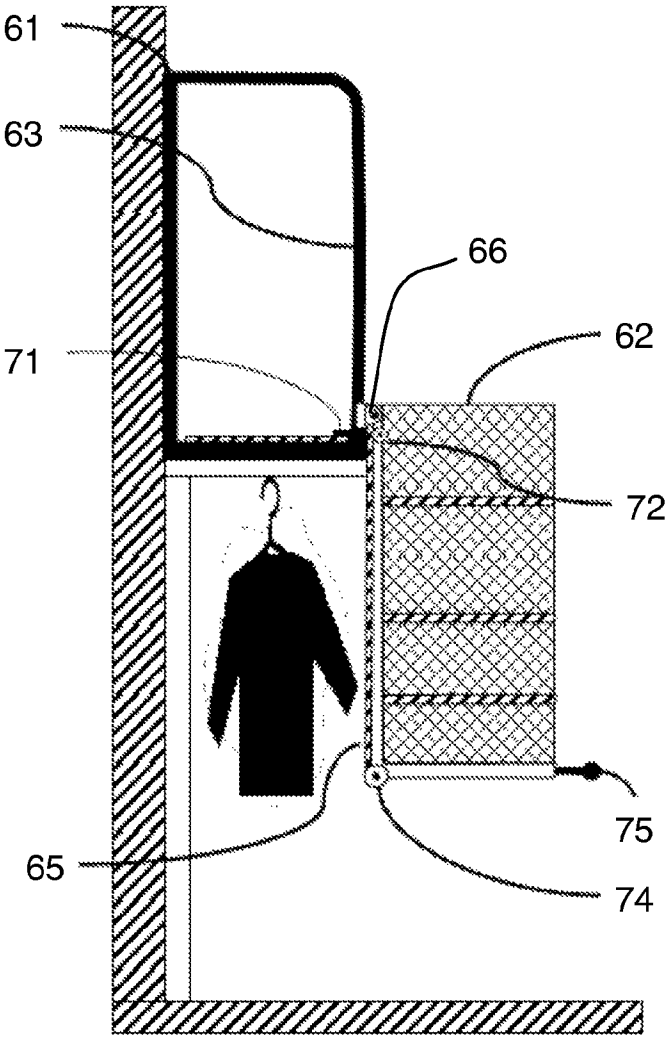
Figure 6C:
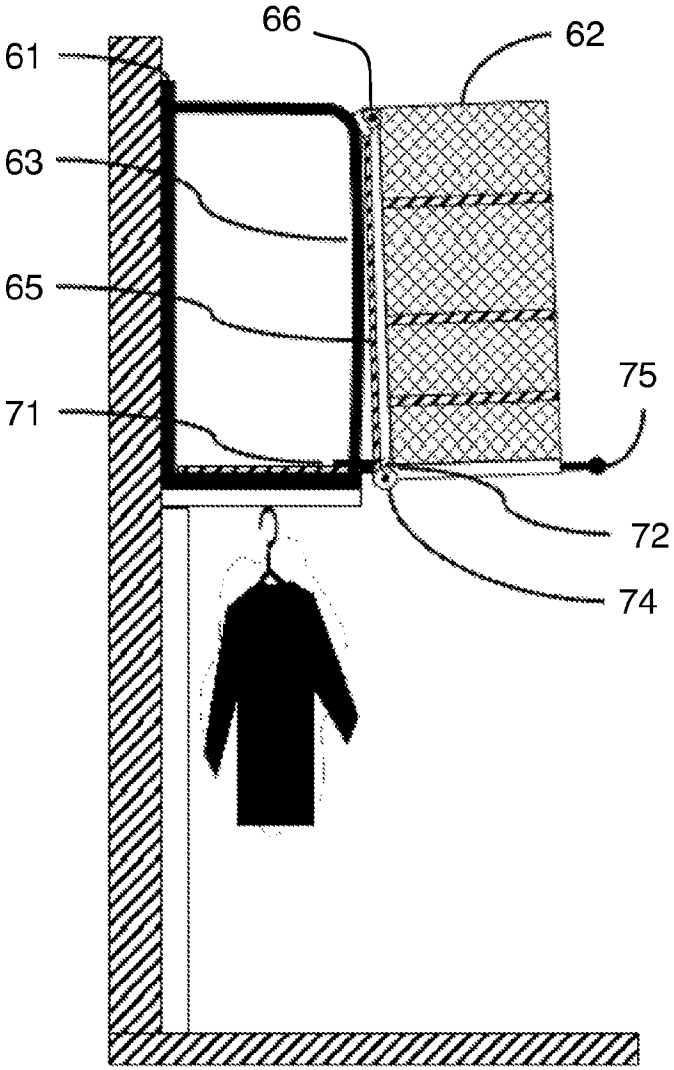

Movable storage section 62 then travels downward as connector element 66 slides along a substantially vertical section of guiding element 63, until the arrangement of FIG. 6*d* is reached, at which point connector element 66 reaches a limit of its travel along guiding element 63. The deployed arrangement of FIG. 6*d* provides a person with easy access to the contents of movable storage section 62. The motion illustrates in FIG. 6 can then be reversed to return movable section 62 to it's retracted position.

Figure 7A:
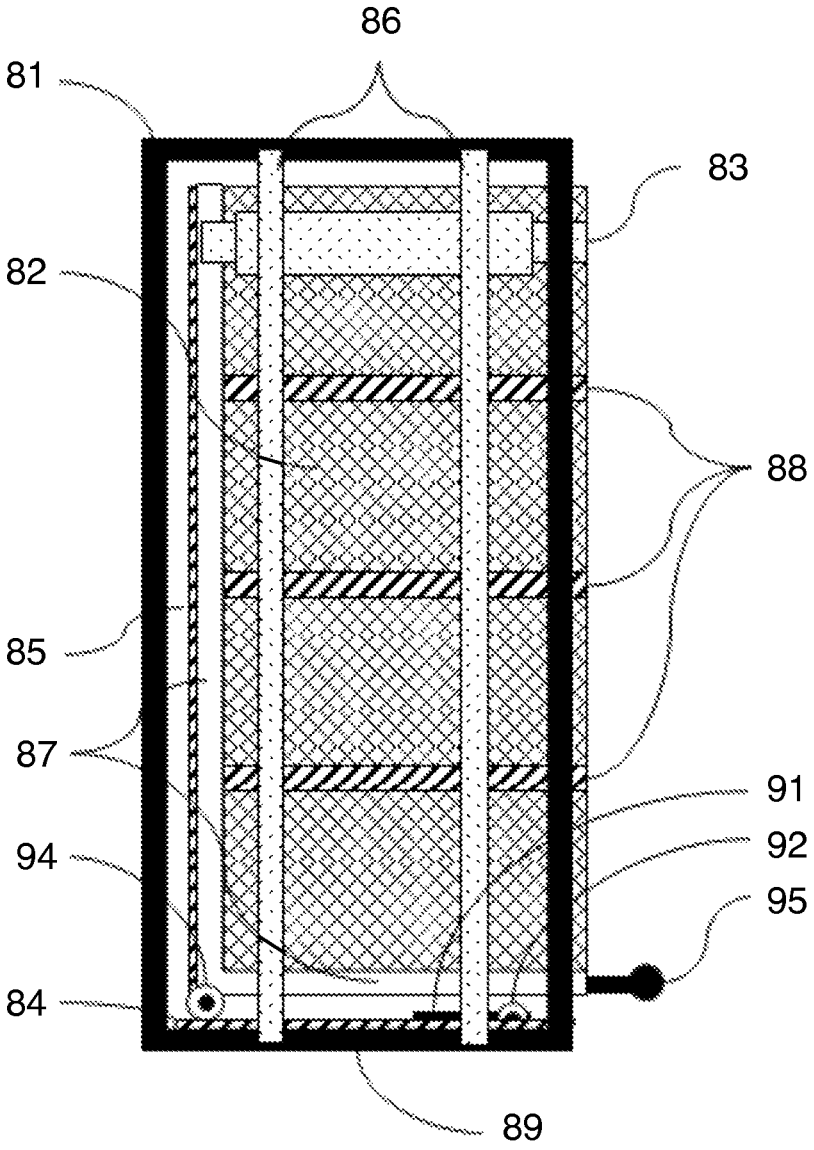
FIG. 7*a* through FIG. 7*c* are side elevations of an embodiment in different phases of deployment of the moveable section using a sliding rail.

In other embodiments, a movable storage section can be mounted on horizontal and vertical slide rails to move through its range of motion. FIG. 7*a* illustrates a side elevation of such an embodiment in a retracted/stowed position. The appearance of the opposing side mirrors that of FIG. 7*a*, with like components on the other side of storage section 82.

Movable storage section 82 includes adjustable shelves 88 and support frames 87. Rear guide wheel 94 is mounted onto support frames 87 and rides on horizontal guide rails 84. Vertical guide rails 85 are adapted to engage sliding carriage 91 and roller bearing 92, similarly to other embodiments described hereinabove. Handle 95 facilitates a user pulling movable section 82 out and down, or pushing movable section 82 up and back.

Stationary frame 81 surrounds movable section 82. Stationary vertical rail guides 86 span top and bottom portions of stationary frame 81. Horizontal full extension slide 83 is slidably mounted on vertical rail guides 86, such that it can move upwards and downwards long the lengths of guides 86.

Deployment of movable section 82 includes both horizontal and vertical phases. From the retracted position of FIG. 7*a*, movable section 82 can be pulled horizontally forward, with rear guide wheel 94 rolling along horizontal guide rail 84, during which time full extension slide 83 is continuously extended. Preferably, full extension slide 83 approaches a limit of its range of motion as vertical guide rail 85 engages with roller bearing 92 and pulls sliding carriage 91 to the limit of its range of motion. This point of full horizontal extension is illustrated in FIG. 7*b*.

Figure 7B:
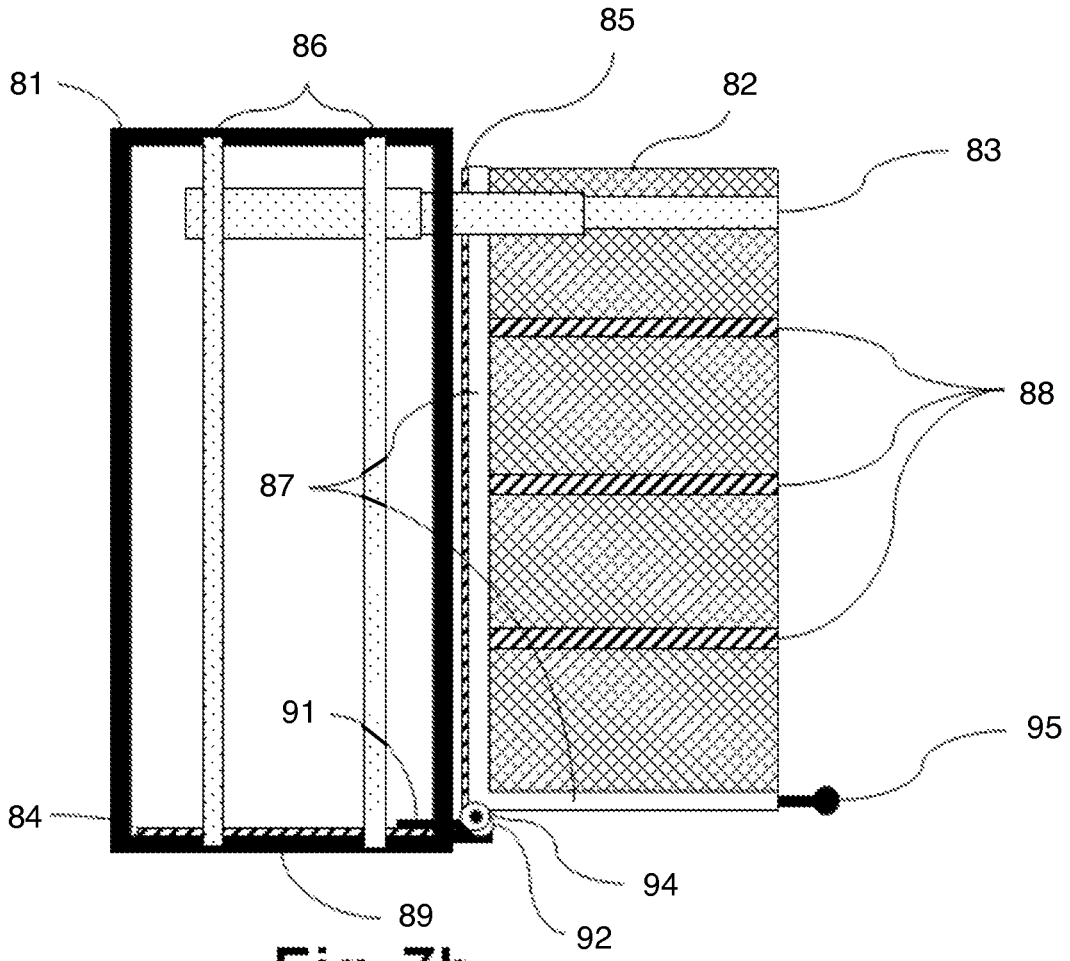
Figure 7C:
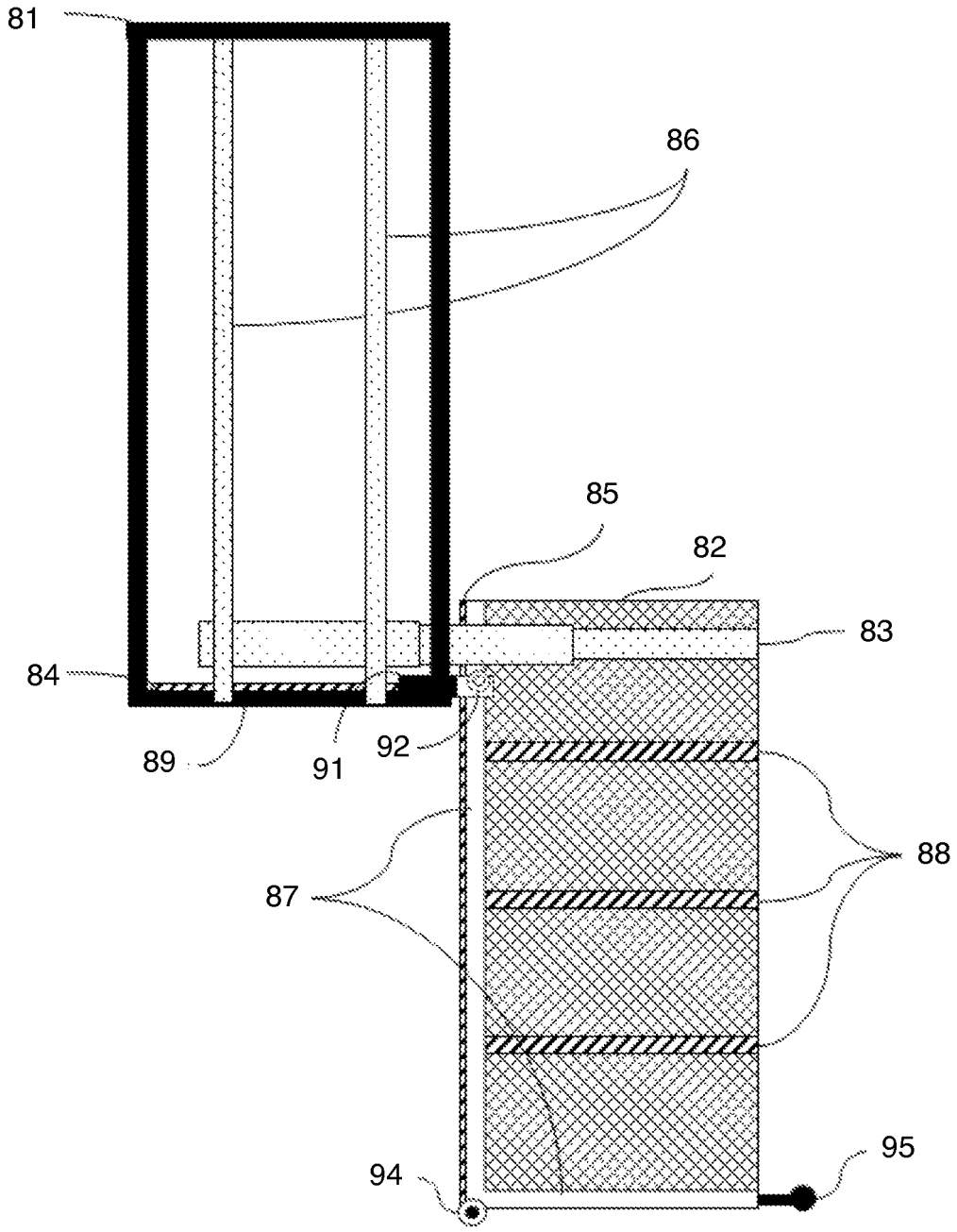

From the position of FIG. 7*b*, movable section 82 can be either retracted horizontally back towards the position of FIG. 7*a*, or extended downwards towards a fully deployed orientation. During downward motion, horizontal slide 83 moves downwards along the length of vertical rail guides 86. FIG. 7*c* illustrates movable section 82 upon reaching its lowest position. Horizontal slide 83 has reached its limit of travel along vertical rail guides 86, and movable section 82 is presented in a lowered position that is more easily accessible to a person. Preferably, in the embodiment of FIG. 7, horizontal slide 83 is mounted to movable section 82 at a position relatively high, or towards the top, of movable section 82, thereby maximizing the distance that movable section 82 can be dropped down for easy access.

While illustrated in various embodiments herein as having adjustable shelves, in other embodiments, the movable section may include fixed shelves, drawers, cubby holes, removable containers, or other mechanisms for storage or organization of items.

In some embodiments, it may be desirable to provide a retractable storage system having adjustable size, so that a single device can be installed in locations of varying dimensions. For example, the embodiment of FIG. 6 could be implemented with adjustable depth to fit varying closet and shelf depths by utilizing a telescoping rail and beam construction for the substantially horizontal portion of guiding element 63, horizontal beams within stationary frame 61, horizontal beams within movable section 62, and horizontal guide rails 76 (with the expansion joint being rearward of the sliding assembly of carriage 71 and roller bearing 72). Similarly, embodiments could be implemented with varying width by implementing laterally-extending components using telescoping construction for laterally-extending rails and beams within the stationary structure and movable section.

In some embodiments, a stationary support structure may be attached to a shelf or cabinet via slides, thereby allowing the entire stationary support structure to be pulled forward prior to movement of the moveable section. In these embodiments, the moveable section would be able to clear any items underneath its path of motion such as non-counter depth refrigerators that protrude beyond the front edge of upper cabinets.

Figure 8A:
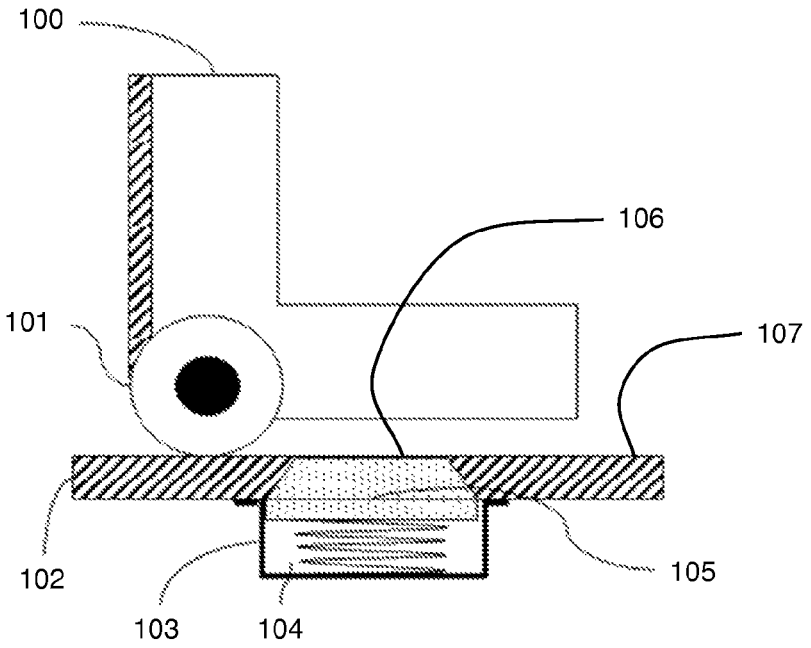
FIGS. 8*a* and 8*b* are partial side cross-sectional views of an embodiment having a safety feature preventing overloading of the movable section.
Figure 8B:
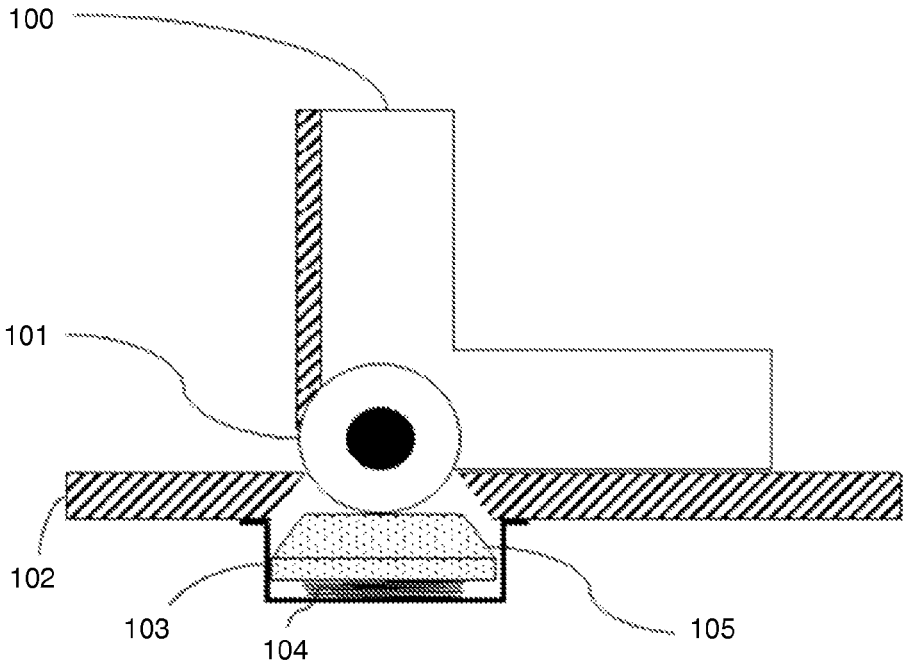

In some embodiments, safety features may be provided to inhibit users from overloading the movable section. For example, FIGS. 8*a* and 8*b* illustrate an embodiment in which motion of the movable section is inhibited when the weight of the loaded movable section exceeds a target level. FIG. 8*a* illustrates a left side of an arrangement with a movable section in motion, just prior to activation of the safety feature. In some embodiments, the corresponding right side will feature a comparable construction; in other embodiments, the safety feature can be implemented on a single side. Rear guide wheels 101 are mounted to movable section frames 100 and roll on horizontal guide rails 102 as the movable section travels through a horizontal phase of motion. Horizontal guide rail 102 includes retractable rail section 105. Enclosure 103 is mounted beneath retractable rail section 105. Spring element 104 is positioned within enclosure 103, biasing retractable rail section 105 upwards such that retractable rail section top surface 106 is normally substantially coplanar with horizontal rail top section 107. Spring element 104 is specified to provide an upward force on retractable rail section 105 substantially equal to the downward force exerted by the rear guide wheel when the movable section is loaded with the maximum desired loaded weight.

If the movable section is loaded with less than the maximum desired loaded weight, rear guide wheels 101 roll across horizontal guide rail 102 and retractable rail section 105 unimpeded. FIG. 8*b* illustrates activation of the safety feature when the movable section has been loaded to a weight exceeding a desired threshold. Rear guide wheels 101 have advanced along horizontal guide rails 102, onto retractable rail section 105. The weight exerted by rear guide wheel 101 compresses spring element 104 such that retractable rail section 105 retracts downward into enclosure 103. Guide wheel 101 also drops into enclosure 103, below the plane of horizontal guide rail 102, thereby impeding further movement of the movable section until the movable section is unloaded to a weight such that spring 104 forces retractable rail section 105 back upwards.

In other embodiments, safety features may be provided to notify a user when the movable section is overloaded, or inhibit accidental injury to a user from an overloaded movable section. For example, a safety cable may connect the movable frame to the stationary frame, so that, e.g., unimpeded fall of the movable section can be avoided in the event of breakage of, e.g., a guide rail or a slide-and-pivot linkage between the guide rail and movable section. In other embodiments, a weight-triggered indicator may be employed to provide a visual indicator to a user when the movable section is loaded beyond a threshold level. These and other safety features can be implemented.

The previous description of the disclosed embodiments is provided to enable any person skilled in the art to make or use the invention disclosed herein. Various modifications to these embodiments will be readily apparent to those skilled in the art, and the generic principles defined herein may be applied to other embodiments without departing from the spirit or scope of the disclosure. Thus, the present disclosure is not intended to be limited to the embodiments shown herein but is to be accorded the widest scope consistent with the principles and novel features disclosed herein.

The invention claimed is:

1. A retractable storage system for positioning a movable storage area between an outside accessible location and a retracted position, comprising:

a movable storage section;

a stationary support structure;

a guiding element spanning an upper-rear portion and a lower-front portion of the stationary support structure, said guiding element substantially defining a path of motion for a top-rear portion of the movable storage section and having a horizontal portion extending from a rear portion of the stationary support structure; and a connector element mounted proximate an upper portion of the movable storage section, the connector element movably connected to the guiding element to define a path of motion for the movable storage section between the outside accessible location and the retracted position.

2. The retractable storage system of claim 1, wherein the path defined by the guiding element from the upper-rear portion of the stationary support structure towards the lower-front portion thereof, is continuously forward and non-ascending.

3. The retractable storage system of claim 1, wherein the guiding element is further comprised of a substantially vertical portion extending down towards the lower-front portion of the station support structure to a lowest, furthest forward position.

4. The retractable storage system of claim 3, in which the horizontal portion of the guiding element and the substantially vertical portion of the guiding element are connected by a convex, curved section of the guiding element.

5. The retractable storage system of claim 1, further comprising a handle connected to a front lower portion of the movable storage section.

6. The retractable storage system of claim 1, wherein the guiding element is a first guiding element connected to a left side of the stationary support structure and the connector element is a first connector element mounted proximate a left side of the movable storage section;

the retractable storage system further comprising a second guiding element connected to a right side of the stationary support structure, the second guiding element running parallel to the first guiding element; and a second connector element mounted proximate a right side of the movable storage section, movably connected with the second guiding element.

7. The retractable storage system of claim 1, further comprising a pair of wheels connected to a lower-rear portion of the movable storage section.

8. A retractable storage system for positioning a movable storage area between an outside accessible location and a retracted position, comprising:

a movable storage section;

a pair of wheels connected to a lower-rear portion of the movable storage section;

a stationary support structure, in which the stationary support structure comprises a pair of horizontal guide rails on which the pair of wheels connected to the movable storage section can travel, the horizontal guide rails extending from a rear part of the stationary support structure to a front part of the stationary support structure;

a guiding element spanning an upper-rear portion and a lower-front portion of the stationary support structure, said guiding element substantially defining a path of motion for a top-rear portion of the movable storage section; and a connector element mounted proximate an upper portion of the movable storage section, the connector element movably connected to the guiding element to define a path of motion for the movable storage section between the outside accessible location and the retracted position.

9. The retractable storage system of claim 8, in which the movable storage section comprises a pair of parallel vertical guide rails affixed to a rear portion thereof;

the system further comprising a sliding assembly placed parallel and proximate to the front of each horizontal guide rail, each sliding assembly comprising:

a sliding carriage;

a roller bearing attached to the sliding carriage and oriented to extend towards a path of the vertical guide rail, such that the roller bearing engages with the vertical guide rail as the vertical guide rail moves towards the front of the stationary support structure; and a spring having a first portion affixed relative to the stationary support structure and a second portion affixed relative to the sliding carriage;

whereby the roller bearing biases the vertical guide rails rearwards when the movable section is in a substantially vertical phase of motion.

10. A retractable storage system for positioning a movable storage area between an outside accessible location and a retracted position, comprising:

a movable storage section comprising a pair of parallel vertical guide rails affixed to a rear portion thereof;

a stationary support structure;

a first guiding element connected to a left side of the stationary support structure and spanning an upper-rear portion and a lower-front portion of the stationary support structure, said guiding element substantially defining a path of motion for a top-rear portion of the movable storage section;

a first connector element mounted proximate an upper portion of the movable storage section left side, the connector element movably connected to the guiding element to define a path of motion for the movable storage section between the outside accessible location and the retracted position;

a second guiding element connected to a right side of the stationary support structure, the second guiding element running parallel to the first guiding element;

a second connector element mounted proximate a right side of the movable storage section, movably connected with the second guiding element; and a pair of retention mechanisms positioned to contact the vertical guide rail as the vertical guide rail moves towards the front of the stationary support structure, the retention mechanism constraining horizontal movement of the movable section during a phase of substantially vertical travel.

11. The retractable storage system of claim 10, in which each retention mechanism further comprises:

a sliding assembly; and a spring having a first portion fixed relative to the stationary support structure and a second portion fixed relative to the retention mechanism.

12. The retractable storage system of claim 11, in which the retention mechanism comprises a roller bearing.

13. The retractable storage system of claim 12, in which the sliding assemblies each further comprise:

a sliding carriage affixed to the roller bearing and to the second portion of the spring, the sliding carriage traveling within a range of motion parallel with a path of movement of the movable section;

whereby the sliding carriages can be extended to a position such that the roller bearings are slightly outside a volume defined by the stationary support structure to allow the movable storage section to slide downward while the roller bearings are biased against the vertical guide rails.

14. The retractable storage system of claim 11, in which the retention mechanism comprises a slot having a size permitting the vertical guide rails to pass therethrough.

15. A retractable storage system for positioning a movable storage area between an extended position and a retracted position, comprising:

a movable storage section;

a stationary support structure;

one or more vertical rail guides affixed to the stationary support structure, positioned outside the movable storage section and spanning the top and bottom of the stationary support structure;

a horizontal slide having a first portion affixed to an outside upper portion of the movable storage section, and a second portion slidably mounted on the vertical guide rails;

whereby the movable storage section can move horizontally via extension of the horizontal slide, and vertically via movement of the horizontal slide along the vertical guide rails.

16. The retractable storage system of claim 15, in which the movable storage section further comprises a pair of wheels connected to a lower-rear portion of the movable storage section.

17. The retractable storage system of claim 15, in which the movable storage section comprises a pair of parallel vertical guide rails affixed to a rear portion thereof;

the system further comprising a pair of retention mechanisms positioned to contact the vertical guide rail as the vertical guide rail moves towards the front of the stationary support structure, the retention mechanism constraining horizontal movement of the movable section during a phase of substantially vertical travel.

18. The retractable storage system of claim 17, in which each retention mechanism further comprises:

a sliding assembly; and a spring having a first portion fixed relative to the stationary support structure and a second portion fixed relative to the retention mechanism.

19. The retractable storage system of claim 17, further comprising a handle connected to a front lower portion of the movable storage section.

* * * * *